US012662846B2

(12) United States Patent
Korfel

(10) Patent No.: US 12,662,846 B2
(45) Date of Patent: Jun. 23, 2026

(54) GROUND SLEEVE FOR INSTALLING A FENCE POST

(71) Applicant: Douglas Korfel, Fort Mill, SC (US)

(72) Inventor: Douglas Korfel, Fort Mill, SC (US)

( * ) Notice: Subject to any disclaimer, the term of this patent is extended or adjusted under 35 U.S.C. 154(b) by 463 days.

(21) Appl. No.: 17/824,271

(22) Filed: May 25, 2022

(65) Prior Publication Data

US 2023/0250672 A1 Aug. 10, 2023

Related U.S. Application Data

(60) Provisional application No. 63/308,734, filed on Feb. 10, 2022.

(51) Int. Cl.
*E04H 17/22* (2006.01)
*E04H 17/20* (2006.01)

(52) U.S. Cl.
CPC ..... *E04H 17/22* (2013.01); *E04H 17/21* (2021.01)

(58) Field of Classification Search
CPC ..... E04H 17/21; E04H 12/223
See application file for complete search history.

(56) References Cited

U.S. PATENT DOCUMENTS 1,284,565 A * 11/1918 Bennett ..... E04H 12/2276 52/297
1,611,935 A * 12/1926 Mitchell ..... E04H 12/2269 52/168
2,261,527 A * 11/1941 Shannon ..... E04H 12/2215 248/545
4,920,897 A * 5/1990 Reed ..... A47B 37/04 108/150
5,165,663 A * 11/1992 Wells ..... E04H 12/2269 52/165
5,535,978 A * 7/1996 Rodriguez ..... E04H 12/2269 248/530
6,267,127 B1 * 7/2001 Doreste ..... E04H 12/2215 52/165
6,820,379 B1 * 11/2004 Krinner ..... E02D 27/14 52/366
6,953,180 B1 * 10/2005 Ruvalcaba ..... E04H 12/2269 248/530
7,264,210 B2 * 9/2007 Yu ..... E04H 12/2269 248/156
7,497,053 B2 * 3/2009 Nicolet ..... E02D 5/805 52/156

(Continued)

FOREIGN PATENT DOCUMENTS

DE 19748386 A1 * 5/1999 ..... E04H 12/2215
DE 102007061534 A1 * 6/2009 ..... E04H 12/2223

(Continued)

*Primary Examiner* — Matthew R McMahon
(74) *Attorney, Agent, or Firm* — Patent 360; Barry Choobin

(57) ABSTRACT

A ground sleeve for installing a fence post, the ground sleeve includes a hollow tube that has a proximal end and a distal end, the proximal end of the hollow tube has an opening for receiving a portion of a fence post. The hollow tube can be inserted into the ground, while the fence post can be received into the hollow tube. The ground sleeve further includes a fastener coupled to a proximal end portion of the hollow tube, the fastener can limit rotation and displacement of the fence post, thus securing it into the ground sleeve.

7 Claims, 4 Drawing Sheets

(56) References Cited

U.S. PATENT DOCUMENTS

| | | | | |
|---|---|---|---|---|
| 9,238,922 | B2 * | 1/2016 | Intagliata | E04H 12/347 |
| 10,559,231 | B2 * | 2/2020 | Kyle | G09F 7/18 |
| 11,187,004 | B2 * | 11/2021 | Narvaez-Newman | E04H 12/223 |
| 12,152,400 | B2 * | 11/2024 | Von Deylen | E04H 12/347 |
| 2004/0129855 | A1 * | 7/2004 | Chen | E04H 17/263 248/545 |
| 2004/0169121 | A1 * | 9/2004 | Winn | A45B 1/00 248/156 |
| 2006/0053704 | A1 * | 3/2006 | Zayeratabat | E02D 27/42 52/165 |
| 2011/0047896 | A1 * | 3/2011 | Vosbikian | A45F 3/44 52/165 |
| 2013/0175422 | A1 * | 7/2013 | Clarke | E04H 12/2269 248/523 |
| 2025/0019992 | A1 * | 1/2025 | Hardee | E04H 17/263 |

FOREIGN PATENT DOCUMENTS

| | | | | |
|---|---|---|---|---|
| EP | 0590367 | A1 * | 4/1994 | E04H 12/2269 |
| GB | 2264730 | A * | 9/1993 | E01F 9/685 |
| WO | WO-8200170 | A1 * | 1/1982 | E04H 12/223 |

* cited by examiner

GROUND SLEEVE FOR INSTALLING A FENCE POST

CROSS-REFERENCE TO RELATED APPLICATIONS

This application claims priority from the U.S. provisional patent application No. 63/308,734 filed on Feb. 10, 2022, which is incorporated herein by reference in its entirety.

FIELD OF INVENTION

The present invention relates to fence posts and ground anchors, and more particularly, the present invention relates to a ground sleeve for installing a fence post.

BACKGROUND

A fence post is a rigid post made from wood or metal that can be fixed upstanding in the ground. A bottom portion of the fence post can be pointed so that the fence post can be pushed into the ground, typically using a hammer. Other ways of installing a fence post are also known such as digging a hole in the ground into which the fence post can be installed. The fence post can be used for a variety of purposes such as spaced-apart supports for the fence, as a milestone, or as a sign.

Many times, a fence post is required to be installed temporarily. Removing the fence post can be a more difficult and tedious process than installing the fence post. Moreover, the removed fencepost may later need to be installed again or replaced by another fencepost. The existing processes for installation, removal, and replacement of a fencepost in soil are complex, laborious, and time-consuming.

Considering the widespread use of the fence posts and the long-standing problem faced in the removal and reinstallation/replacement of the fence posts, a need is there for a device that solves the aforesaid problems.

SUMMARY OF THE PRESENT INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a ground sleeve for installing fence posts.

It is another object of the present invention that the ground sleeve allows removing the fence post with little effort and less time.

It is another object of the present invention that the fence post can be replaced as and when desired both easily and quickly.

It is still another object of the present invention that the height of the fence post can be adjusted.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
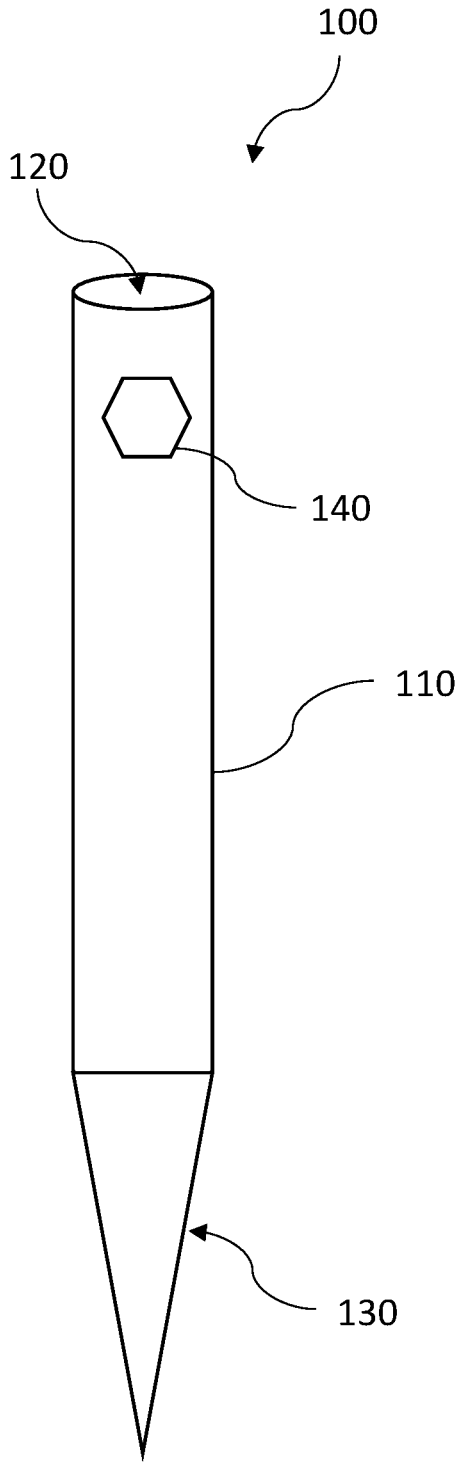
FIG. 1 is a perspective view of the disclosed ground sleeve, according to an exemplary embodiment of the present invention.
Figure 2:
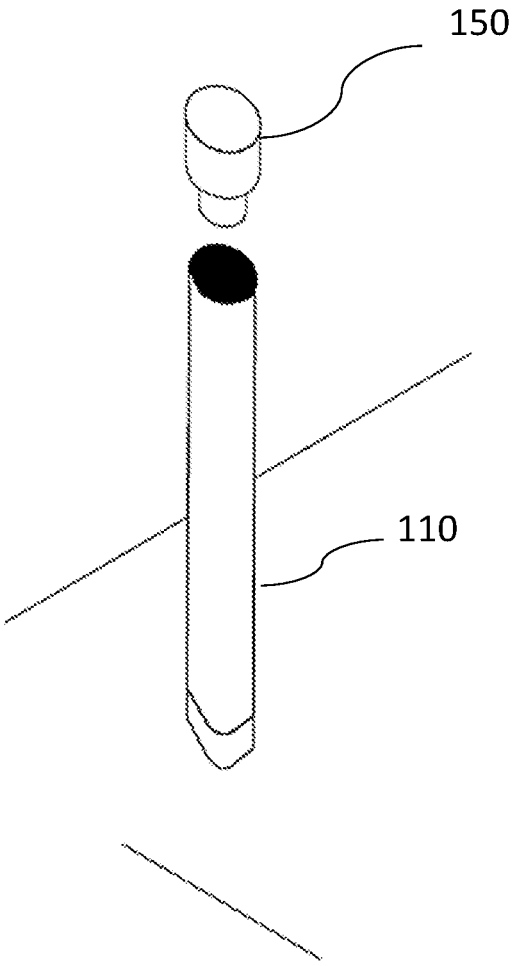
FIG. 2 shows the ground sleeve with an anvil, according to an exemplary embodiment of the present invention.
Figure 3:
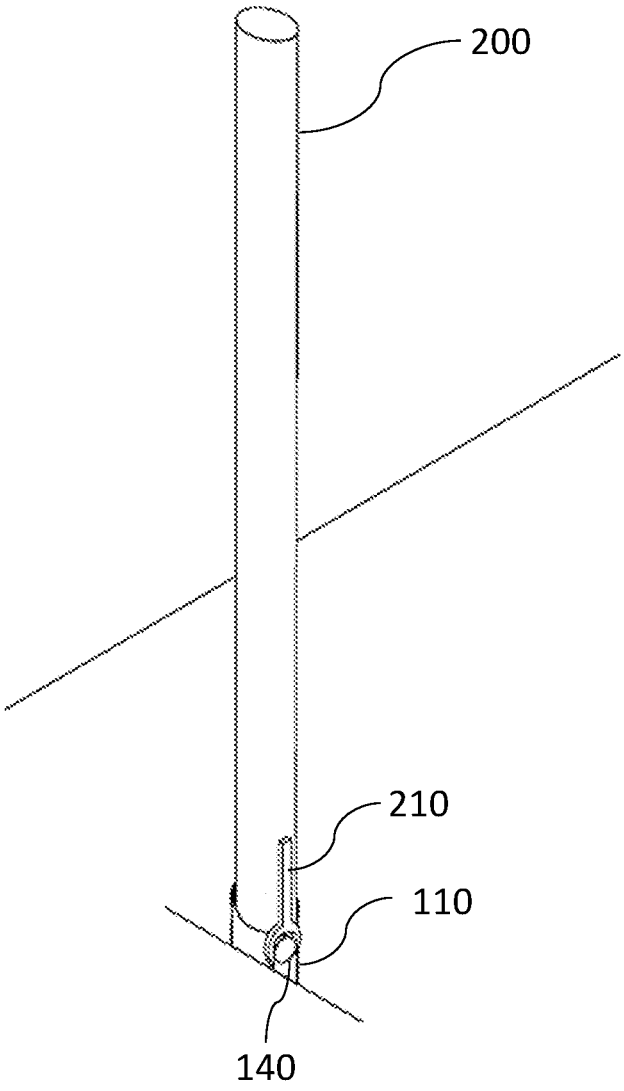
FIG. 3 shows the installation of the fence post in the ground sleeve, according to an exemplary embodiment of the present invention.
Figure 4:
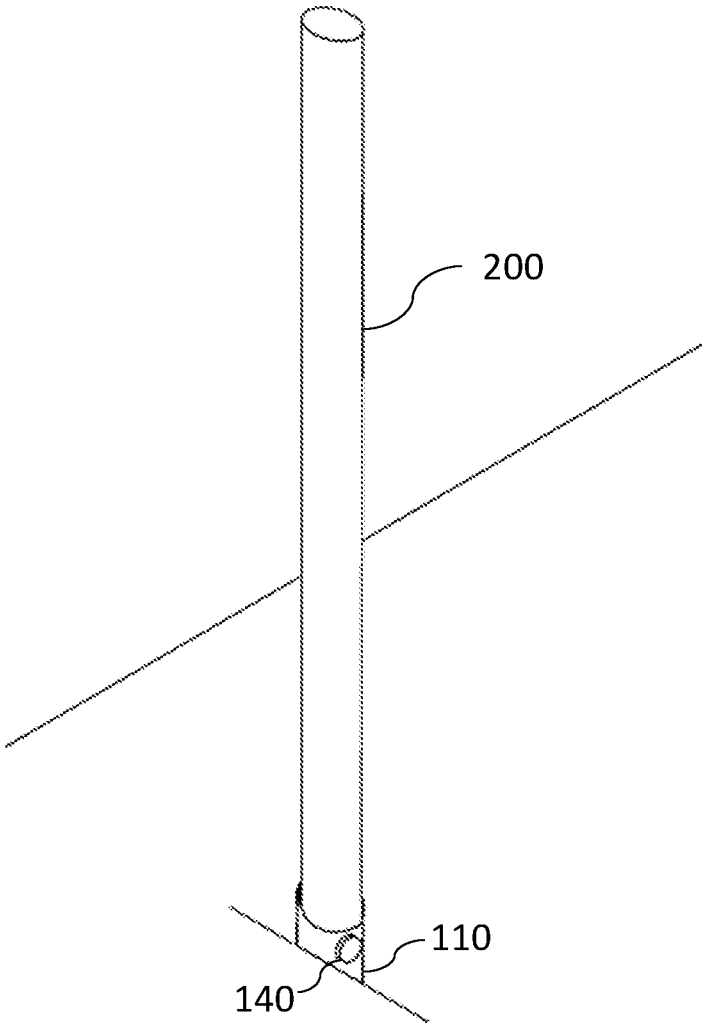
FIG. 4 shows the fence post installed in the ground sleeve, according to an exemplary embodiment of the present invention.

Disclosed is a ground sleeve that can be used to removably install a fence post in the ground. Referring to FIGS. 1-5 which show an exemplary embodiment of the ground sleeve 100 and installation of a fence post 200. The ground sleeve 100 can include a hollow tube 110 of an elongated geometry that includes a proximal end and a distal end. The proximal end has an opening 120 for receiving the fence post 200. The distal end can be closed and configured to be inserted into the ground/soil. In one case, the distal end of the hollow tube 110 can be a pointed end 130 so that the hollow tube can be forced into the ground. However, the distal end of the hollow tube can also be flat and any other mechanism of the installation of the ground sleeve into the ground is within the scope of the present invention. The hollow tube can be made from a rigid and durable material such as steel. Preferably, the hollow tube can be made from a corrosion resistance material, or a layer of corrosion-resistant material can be applied to the surface of the hollow tube to prevent rusting. The length of the hollow tube can be varied and may depend upon the length of the fence post, the weight of the fence post, and like factors.

An upper portion of the hollow tube 110 at the proximal end can have a threaded hole passing through a wall of the hollow tube 110. A fastener 140 can be coupled to the threaded hole in the hollow tube 110. The fastener 140 can have a head and a threaded tail, wherein the threads of the tail can correspond to the threads of the hole so that the fastener can be screwed into the threaded hole. The head of the fastener can be held and rotated by suitable tools, such as a wrench 210. In one case, the fastener can be a hex nut having a hexagonal head and threaded tail.

In use, the hollow ground sleeve can be inserted into the ground. The pointed distal end of the ground sleeve can be pointed at the desired position on the ground and the ground sleeve can then be forced into the ground. For example, using the hammer, the proximal end of the hollow tube can be forced into the ground, or by using any similar force, causing a portion of the hollow tube to be inserted into the ground. An anvil 150 can also be provided that is made of solid material and which can fit into the proximal end opening 120 of the hollow tube 110. The anvil 150 can be hammered rather than directly striking the proximal end of the hollow tube. The use of the anvil 150 may result in uniform distribution of force resulting in the straight insertion of the hollow tube in the ground, also any damage to the hollow tube by the hammer can be avoided. The anvil can be removed once the hollow tube is inserted into the ground.

The upper portion of the hollow tube 110 that has the fastener 140 can remain above the ground. Once, the ground sleeve 100 is installed, the fence post 200 can be installed in the ground sleeve 100. The fence post 200 can be received within the hollow tube 110 through the proximal end opening 120. Once the post of the fence post 200 is well received within the hollow tube 110, the fastener 140 can be tightened to secure the fence post. The fastener can be frictionally pressed against the post of the fence post 200 to prevent rotation and displacement of the fence post. Alternatively, the fence post can have spaced-apart holes or grooves, and the fastener can be inserted into one of such holes or grooves for securing the fence post. The spaced apart holes or grooves can also allow length adjustment of the fence post.

To remove the fence post, the fastener can be loosened, and the fence post can then be easily pulled out of the ground sleeve. The ground sleeve can remain in the ground and a new fence post can be installed in the ground sleeve as and when desired. The proximal end opening of the ground sleeve can be closed when not in use to prevent the ingress of water and dust.

It is to be understood that the drawings show a set screw as the means for securing the fence post installed in the ground sleeve, however, any other type of fastener or any means to restrict the displacement and rotation of the fence post within the ground sleeve are within the scope of the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A ground sleeve for removably installing a fence post, the ground sleeve consisting of:

a hollow tube that has a proximal end and a distal end, the proximal end of the hollow tube has an opening for receiving a portion of a fence post, the distal end of the hollow tube is closed and gradually narrows to a tip of conical shape;

a single fastener coupled to a proximal end portion of the hollow tube, the single fastener configured to limit rotation and displacement of the fence post received within the hollow tube, the fastener is a set screw or a threaded hex bolt; and an anvil made of solid material, wherein the anvil has a base and a head, a diameter of the head is larger than the proximal end opening, and a diameter of the base is lesser than the proximal end opening such that the head rests over and engages the proximal end of the hollow tube such that a force applied to the head of the anvil will be transferred to the proximal end of the hollow tube to drive the hollow tube into the ground, wherein the head is of a cylindrical shape.

2. The ground sleeve according to claim 1, wherein the fastener is the threaded hex bolt, the proximal end portion of the hollow tube has a threaded aperture, wherein the threaded hex bolt screws into the threaded aperture.

3. The ground sleeve according to claim 1, wherein the fastener is the set screw.

4. A method for installing a fence post, the method comprising:

providing a ground sleeve, the ground sleeve consisting of:

a hollow tube that has a proximal end and a distal end, the proximal end of the hollow tube has an opening for receiving a portion of a fence post, the distal end of the hollow tube is closed and gradually narrows to a tip of conical shape, a single fastener coupled to a proximal end portion of the hollow tube, the single fastener is configured to limit rotation and displacement of the fence post received within the hollow tube, the fastener is a set screw or a threaded hex bolt, and an anvil made of solid material, wherein the anvil has a base and a head, a diameter of the head is larger than the proximal end opening, and a diameter of the base is lesser than the proximal end opening such that the head rests over and engages the proximal end of the hollow tube, wherein the head is of a cylindrical shape;

coupling the anvil over the proximal end opening;

upon coupling, inserting the ground sleeve into ground up to the proximal end portion, by hammering the anvil such that a force applied to the head of the anvil is transferred to the proximal end of the hollow tube to drive the hollow tube into the ground;

upon inserting, removing the anvil;

upon removing, receiving the portion of the fence post within the hollow tube through the opening; and tightening the fastener against the portion of the fence post.

5. The method according to claim 4, wherein the method further comprises:

upon tightening the fastener, loosening the fastener; and upon loosening, pulling out the portion of the fence post.

6. The method according to claim 5, wherein the fastener is the threaded hex bolt, the proximal end portion of the hollow tube has a threaded aperture, wherein the threaded hex bolt screws into the threaded aperture.

7. The method according to claim 4, wherein the fastener is the set screw.

* * * * *